US005954118A

United States Patent [19]

Praeg

[11] Patent Number: 5,954,118

[45] **Date of Patent: *Sep. 21, 1999**

[54] APPARATUS FOR EFFICIENT SIDEWALL CONTAINMENT OF MOLTEN METAL WITH HORIZONTAL ALTERNATING MAGNETIC FIELDS UTILIZING LOW RELUCTANCE RIMS

[75] Inventor: Walter F. Praeg, Palos Park, Ill.

[73] Assignee: ARCH Development Corporation, Argonne, Ill.

[ * ] Notice: This patent is subject to a terminal disclaimer.

[21] Appl. No.: 08/606,583

[22] Filed: Feb. 26, 1996

Related U.S. Application Data

[62] Continuation-in-part of application No. 08/381,717, Jan. 31, 1995, Pat. No. 5,601,104, which is a continuation-in-part of application No. 07/952,519, filed as application No. PCT/US90/03243, Jun. 7, 1990, Pat. No. 5,385,201, which is a continuation of application No. 07/272,353, Nov. 17, 1988, Pat. No. 4,936,374.

[51] Int. Cl.[6] ..... B22D 27/02; B22D 11/06

[52] U.S. Cl. ..... 164/503; 164/428

[58] Field of Search ..... 164/502, 503, 164/466, 467, 480, 428

[56] References Cited

U.S. PATENT DOCUMENTS

| | | | |
|---|---|---|---|
| 4,082,207 | 4/1978 | Garnier et al. . | |
| 4,607,681 | 8/1986 | Tinnes et al. . | |
| 4,741,383 | 5/1988 | Hull et al. . | |
| 4,762,653 | 8/1988 | Senillou et al. . | |
| 4,936,374 | 6/1990 | Praeg | 164/480 |
| 4,947,661 | 8/1990 | Lari et al. . | |
| 5,251,685 | 10/1993 | Praeg | 164/467 |
| 5,385,201 | 1/1995 | Praeg | 164/480 |
| 5,601,140 | 2/1997 | Draeg | 164/503 |

FOREIGN PATENT DOCUMENTS

| | | |
|---|---|---|
| 57-177861 | 11/1982 | Japan . |
| 60-106651 | 6/1985 | Japan . |
| 62-104653 | 5/1987 | Japan . |
| 63-97341 | 4/1988 | Japan . |
| 63-112046 | 5/1988 | Japan . |
| 9801-266946 | 10/1989 | Japan . |
| 383524 | 8/1973 | U.S.S.R. . |
| 980937 | 12/1982 | U.S.S.R. . |
| 1530326 | 12/1989 | U.S.S.R. . |

*Primary Examiner*—Kuang Y. Lin
*Attorney, Agent, or Firm*—Foley & Lardner

[57] ABSTRACT

A method and apparatus for casting sheets of metal from molten metal. The apparatus includes a containment structure having an open side, a horizontal alternating magnetic field generating structure and rollers including low reluctance rim structures. The magnetic field and the rollers help contain the molten metal from leaking out of the containment structure.

18 Claims, 13 Drawing Sheets

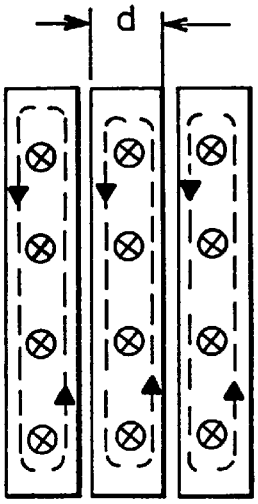
FIG. 5
FIG. 6A
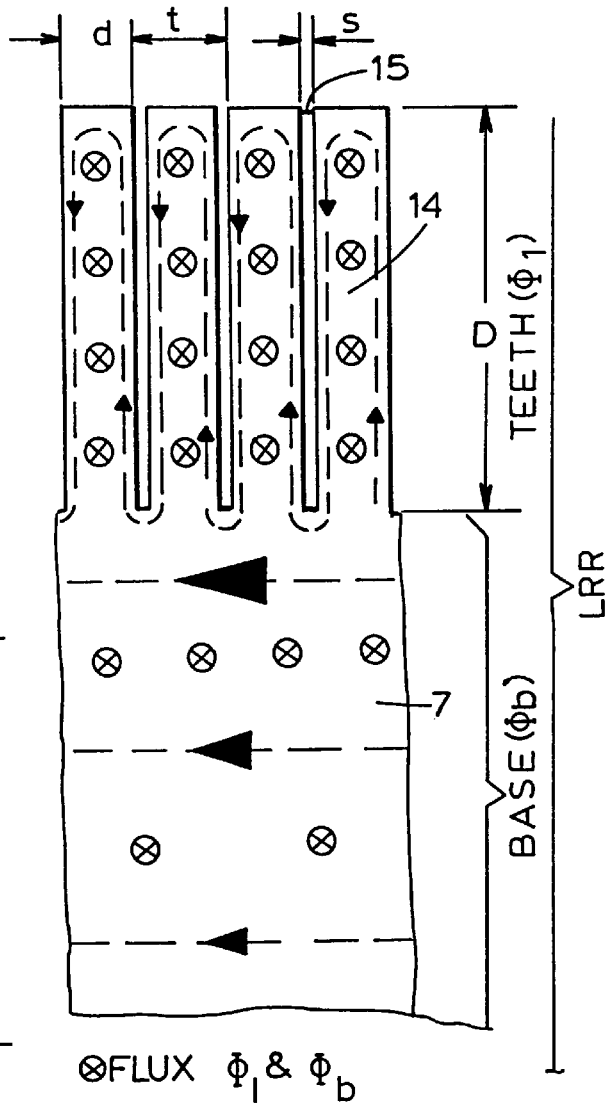
FIG. 6B
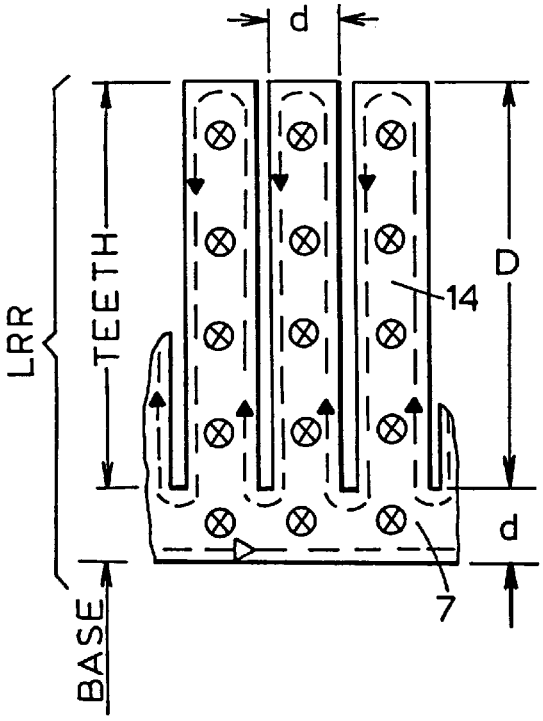

FIG. 22
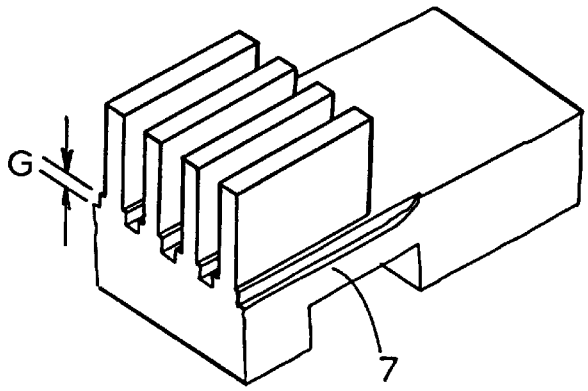
FIG. 23
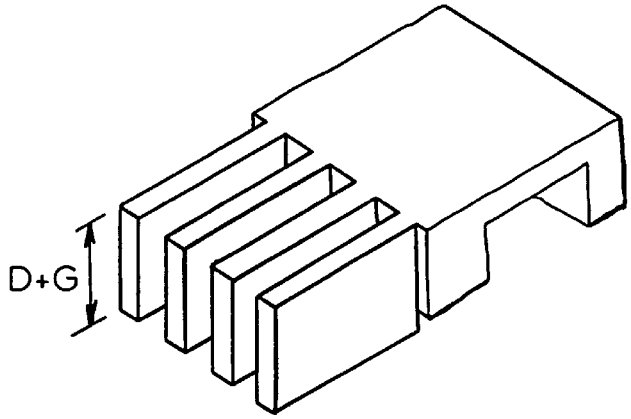
FIG. 24
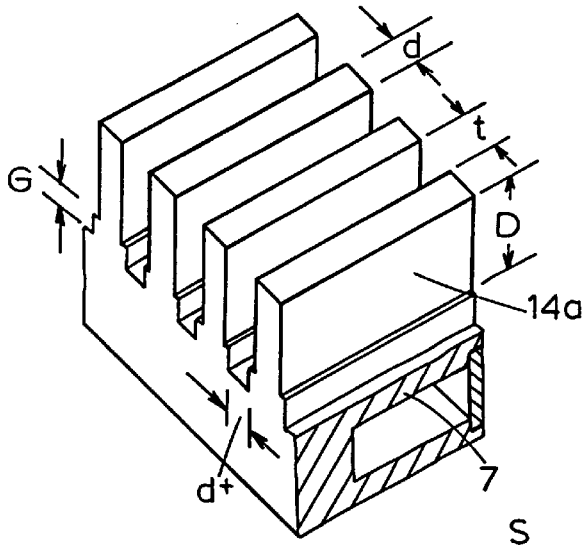
FIG. 25
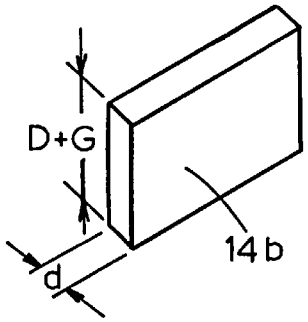
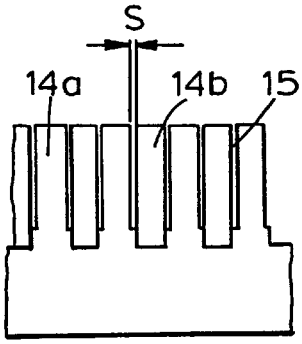
FIG. 26

FIG. 29
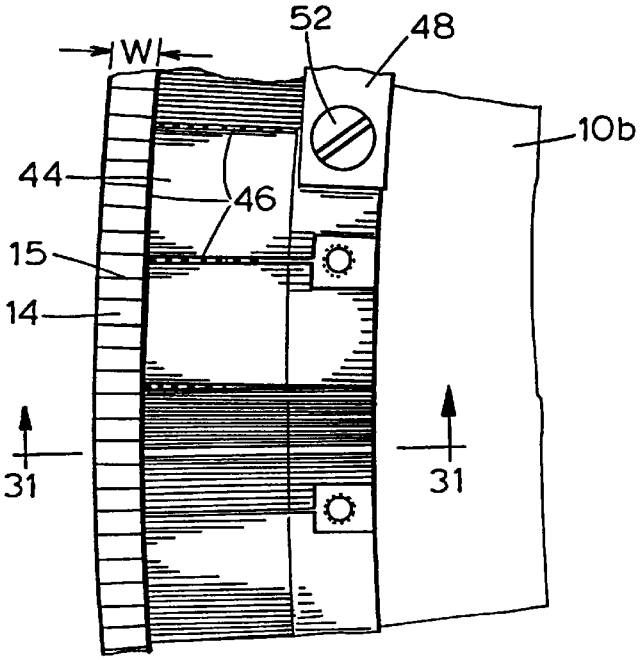
FIG. 30
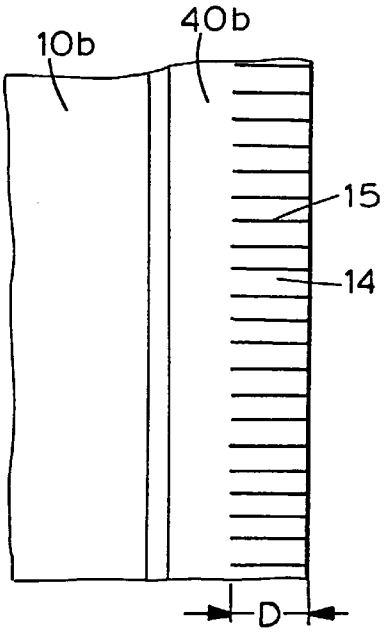
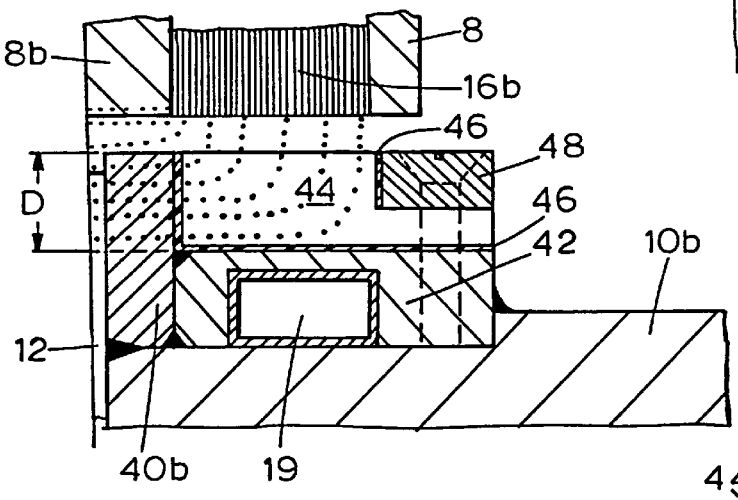
FIG. 31
FIG. 32
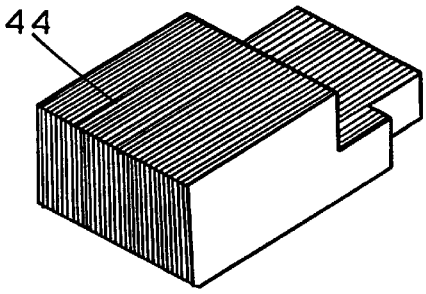

FIG. 36
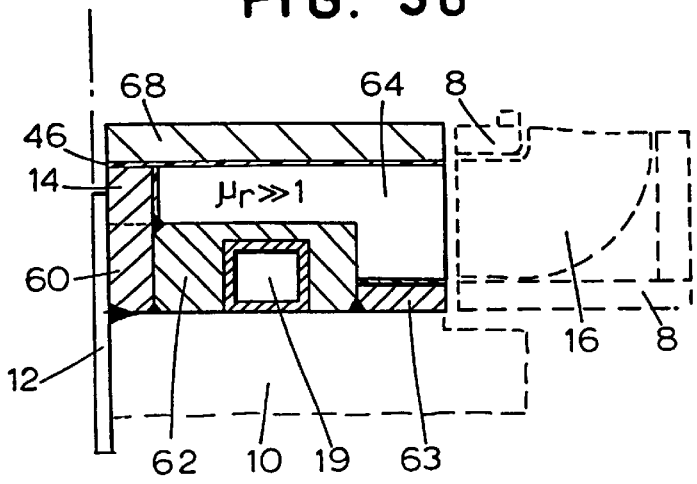
FIG. 37
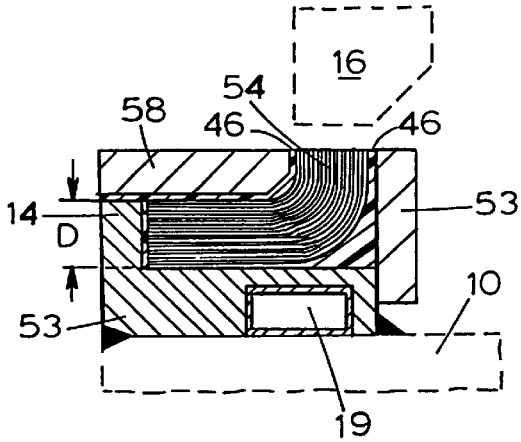
FIG. 38
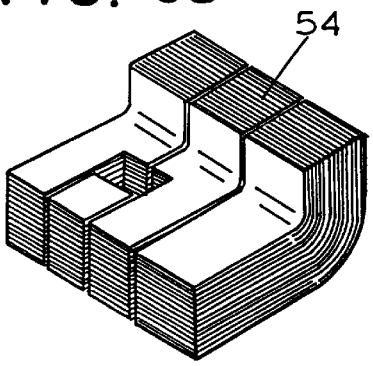
FIG. 39
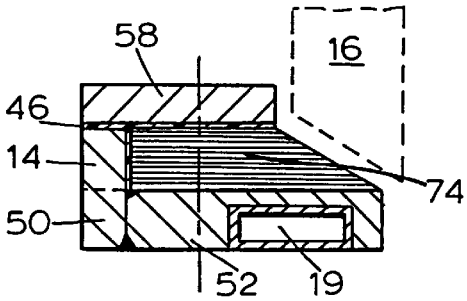
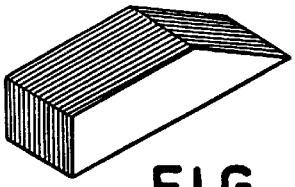
FIG. 40

APPARATUS FOR EFFICIENT SIDEWALL CONTAINMENT OF MOLTEN METAL WITH HORIZONTAL ALTERNATING MAGNETIC FIELDS UTILIZING LOW RELUCTANCE RIMS

This is a continuation-in-part of application Ser. No. 08/381,717 filed on Jan. 31, 1995 now U.S. Pat. No. 5,601,104, and which is a continuation-in-part of application Ser. No. 07/952,519 filed on Jul. 23, 1993, which issued as U.S. Pat. No. 5,385,201 and which is derived from an international application designated U.S., based on PCT/US90/03243 filed on Jun. 7, 1990; and which is a continuation application of Ser. No. 07/272,353 filed on Nov. 17, 1988, which issued as U.S. Pat. No. 4,936,374.

(which was made with United States Government support under Contract No. W-31-109-ENG-38 awarded by the Department of Energy). The United States Government has certain rights in this invention.

FIELD OF THE INVENTION

The present invention generally relates to electromagnetically confining molten metal. More specifically, the present invention relates to efficiently confining molten metal near edges of substantially parallel rollers as a solid metal sheet is cast by counter-rotation of the rollers.

BACKGROUND OF THE INVENTION

Advantages obtained from continuous casting of metal sheets with counter-rotating rollers and electromagnetic confinement of the molten metal at the edge of the rollers are described in U.S. Pat. Nos. 4,936,374 and 5,385,201. These patents are parent applications of the present application, were granted to the inventor of the present invention, and are assigned to the same entity as this application.

A combination of mechanical and electromagnetic means to contain molten metal at the edges of counter-rotating rollers is described in U.S. Pat. Nos. 4,936,374 and 5,385,201. Methods are described in these patents to achieve low reluctance at the edges, or rim portions, of the counter-rotating rollers for horizontal alternating magnetic flux which confines the molten metal between the rim portions of the rollers. These methods range from extending the rollers with solid stainless steel rims to cutting slots into the roller rims and filling the slots with refractory material, stainless steel or ferromagnetic laminations. Other methods described use laminated hoops for the roller extension or hoop-shaped magnet pole assemblies contained inside rims which are welded to the rollers.

All of the above methods have drawbacks for certain practical applications. Saw-cut slots are typically $\geqq 0.8$ mm (0.031") wide. High temperature slot-fillers cause an uneven roller-rim-surface and reduce the thermal conductivity and mechanical strength of the roller rim edge. The slot-filler, whether refractory material, stainless steel or a combination of metal and adhesive, is exposed to thermal expansion due to the molten metal and to deformation due to roller pressure once every roller revolution. This will deteriorate the slot-filler and cause consequential deformation of the surface of the edge of the steel-strip being cast.

Because slotted low reluctance rims add complexity to the roller design of twin-roller-casters utilizing horizontal alternating magnetic fields for sidewall containment, twin-roller-casters have typically used solid roller rims. It was erroneously assumed that twin-roller-caster-rollers could easily absorb the eddy current losses in their rims and that cooling of the edges of the cast metal-sheet would not be adversely affected by the eddy current losses in the roller rims. Recent experiments with solid rollers have shown that eddy current losses in the roller rims produce red-hot temperatures therein. This reduces the roller rims' ability to cool and solidify the sheet being cast at the edge of the roller in comparison with the much cooler center portion of the rollers which are not exposed to eddy currents. This phenomenon often prevents the cast metal sheet from solidifying satisfactorily at the edges. In addition, the large eddy current losses in the roller rims substantially increase the power requirements and magnet costs for electromagnetic sidewall containment of molten metal.

Accordingly, it is an object of the present invention to provide a novel apparatus and method for preventing a pool of molten metal from flowing over the ends of counter-rotating rollers, comprising a shaped horizontal alternating magnetic field and low reluctance rims for the rollers to reduce eddy current losses in the rim portion of the rollers when casting metal sheets.

It is still another object of the present invention to provide a novel apparatus and method for preventing a pool of molten metal from flowing over the ends of counter-rotating rollers, comprising a shaped horizontal alternating magnetic field and low reluctance rims being part of the rim or edge portion of rollers otherwise made from one solid metal.

It is still another object of the present invention to provide a novel apparatus and method for preventing a pool of molten metal from flowing over the ends of counter-rotating rollers, comprising a shaped horizontal alternating magnetic field and low reluctance rims being part of rollers having multilayer construction of different metals.

It is a further object of the present invention to provide an improved method and apparatus for preventing a pool of molten metal flowing over the ends of counter-rotating rollers, comprising a shaped horizontal alternating magnetic field and low reluctance rims with ferromagnetic inserts to reduce roller-rim-losses, to force a more uniform field distribution in the low reluctance rims and to reduce the magnetomotive force required for the containment field.

It is a still further object of the present invention to provide an improved method and apparatus for preventing molten metal from flowing over the ends of solid or multilayer counter-rotating rollers, comprising low reluctance rims which are attached to the sidewalls of the rollers of a caster.

It is a further object of the invention to provide a novel method and apparatus that contains electromagnetically molten metal between counter-rotating rollers with a minimum of power dissipation in the edges (rims) of the rollers.

It is still a further object of the invention to provide an improved method and apparatus that contains a pool of molten metal from flowing out sides of a containment means with a minimum of electrical power consumed by the containment means.

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements.

BRIEF DESCRIPTION OF DRAWINGS

FIG. 5 shows the flux and eddy current distribution in conventional low-loss laminated structures.

FIG. 6A shows the flux and eddy current distribution in a slotted plate with a thick base in accordance with another preferred embodiment of the invention.

FIG. 6B shows the flux and eddy current distribution in a slotted plate having a thin base in accordance with another preferred embodiment of the invention.

FIG. 22 is an isometric view of the lower part of another low reluctance rim of the present invention.

FIG. 23 is an isometric view of the upper part of another low reluctance rim of the present invention.

FIG. 24 is an isometric view of a part of a low reluctance rim in accordance with the present invention.

FIG. 25 is an isometric view of a tooth for installation in the low reluctance rim of FIG. 24.

FIG. 26 is a front view of a low reluctance rim of the present invention showing the parts of FIGS. 24 and 25 assembled.

FIG. 29 is a top view of a ferromagnetic low reluctance rim of the present invention.

FIG. 30 is a side view of a ferromagnetic low reluctance rim of the present invention.

FIG. 31 is a view along line 31—31 of FIG. 29.

FIG. 32 is an isometric view of a ferromagnetic laminations assembly.

FIG. 36 is a cross-section of still another ferromagnetic low reluctance rim embodiment of the present invention.

FIG. 37 is a cross-section of a ferromagnetic low reluctance rim embodiment of the present invention with tape-wound laminations.

FIG. 38 is an isometric view of the laminations of FIG. 37.

FIG. 39 is a cross-section of a ferromagnetic low reluctance rim embodiment of the present invention with straight laminations.

FIG. 40 is an isometric view of alternate laminations for the embodiment of the invention shown in FIG. 39.

DETAILED DESCRIPTION OF THE INVENTION

Figure 1:
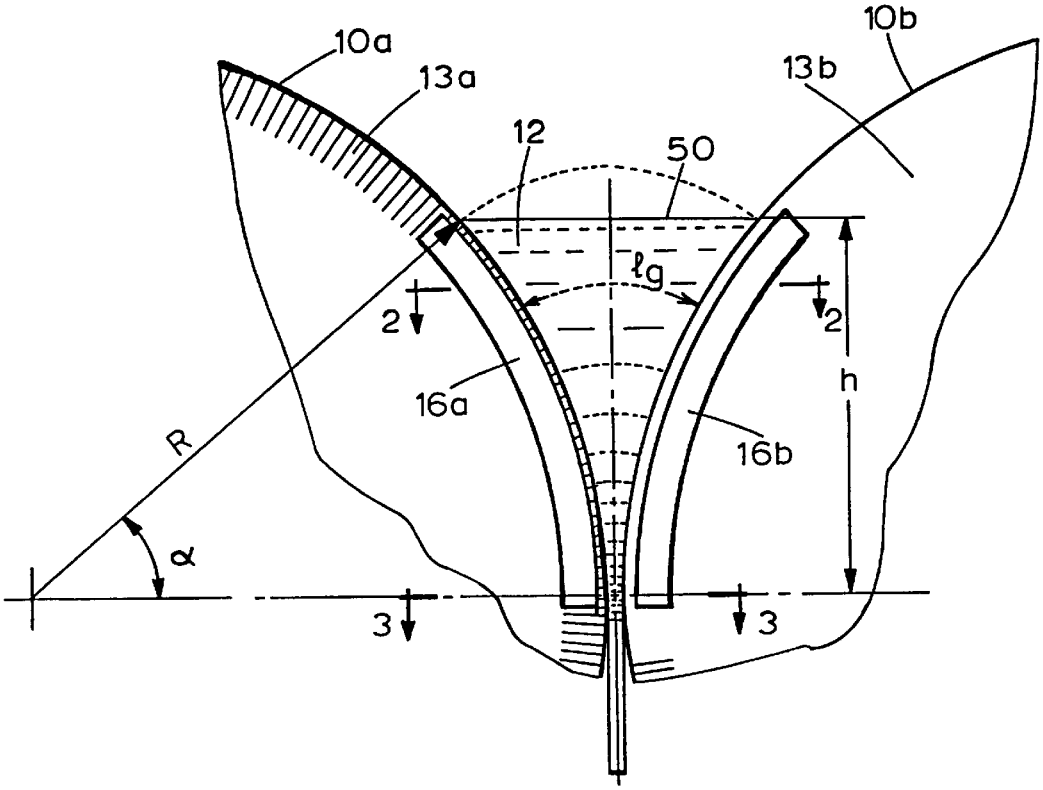
FIG. 1 illustrates a front view of an apparatus for electromagnetic containment as described in U.S. Pat. Nos. 3,936,374 and 5,385,201.
Figure 2:
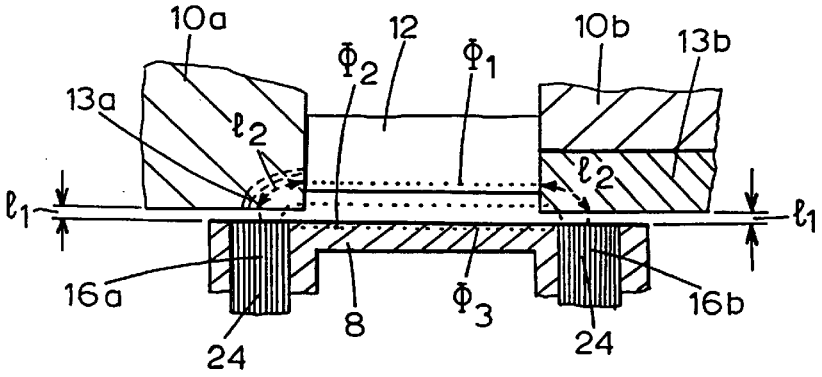
FIG. 2 shows a view along line 2—2 of FIG. 1.

FIGS. 1 and 2 depict apparatus for electromagnetic sidewall containment of molten metal with twin-roller-casters as described in U.S. Pat. Nos. 5,385,201 and 4,936,374. Containment flux must pass through the sidewall rims 13 of rollers 10 to enter a side of the pool of molten metal 50.

Two low reluctance rim designs are depicted in accordance with the above mentioned patents. One, shown on the left hand sides of FIG. 1 and FIG. 2, has relatively wide slots sawn into its rim to lower its reluctance. The slots are filled with refractory material, stainless steel or ferromagnetic material or a combination of these materials. The second low reluctance rim design is shown on the right hand sides of FIG. 1 and FIG. 2. It comprises a stainless steel plate welded to a copper alloy roller 10. The stainless steel plate is at least as thick as one skin depth of the operating frequency in order to provide sufficient cross-section for the magnetic flux. Flux paths are shown with dotted lines in FIGS. 1 and 2. For slotted rims, the slot-filler must be compatible with the temperature and pressure fluctuation of every roller revolution. High eddy current losses can be problematic with the solid stainless steel plates as will be discussed below.

As illustrated in FIGS. 1 and 2, an alternating magnetic field, produced by containment magnet 24, passes through the sidewall rims 13 of rollers 10 between magnet poles 16. Horizontal flux lines $\phi_1$ penetrate the molten metal 12 of pool 50. The horizontal flux lines induce vertical eddy currents which, by interaction with flux $\phi_1$, produce an electromagnetic containment force, $F_m$, wherein:

$$F_m = B^2/(2\mu_0) \quad (1)$$

Flux lines $\phi_2$ in front of the sidewall of molten metal 12 do not contribute to sidewall containment. Flux lines $\phi_3$ in the copper shield 8 of the containment magnet 24 cause eddy current losses and undesirable heating.

FIG. 1 illustrates how the length of the flux path in the molten metal 12, $l_g$, increases from where the solidified metal leaves the rollers (the horizontal line where the separation of rollers 10 is smallest-also called the nip) up to the surface of pool 50 of molten metal 12.

As described in U.S. Pat. No. 4,936,374, the magnetic field (B) required to contain the gravitational pressure, without any safety factor (SF1), is:

$$B_{SF1}=(2\mu_o g\xi h)^{1/2}=k(h)^{1/2} \tag{2}$$

where:

$\mu_0$=the permeability of free space;

$$\mu_o = 0.4\pi\ \frac{\text{Gcm}}{\text{A}};$$

g=acceleration of gravity;

ξ=density of the molten metal;

h=vertical distance from the pool surface to a point of the sidewall; and

For steel k ~421 when B is measured in Gauss, G, and h in cm.

The containment magnet 24 preferably has high relative permeability core, $\mu_r \geqq 2{,}000$. Its permeability, $\mu=\mu_o\ \mu_r$, is very much larger than the permeability of the flux-paths through air, the roller rims and the molten metal; all of which have a permeability of $\mu=\mu_o$. Because the containment magnet 24 has laminated ferromagnetic material $\mu>>\mu_0$ between its poles 16, the magnetomotive force required to produce flux density $B_{SF1}$ called for by Eq. (2) can be calculated from the flux path length $l_1$, $l_2$ and $l_3$ shown in FIGS. 1 and 2.

The flux path length is:

$$\Sigma l=2(l_1+l_2)+l_g \tag{3}$$

The required magnetomotive force is:

$$mmf = \sum l\frac{B}{\mu_o}. \tag{4}$$

Combining (2) and (3) yields:

$$mmf_{SF1} = k(h)^{1/2}\frac{\sum l}{\mu_o}. \tag{5}$$

In addition to gravitational forces, the sidewall of pool 50 of molten metal 12 is also exposed to fluctuating forces caused by the molten metal feed system and roller-induced forces. Therefore, the electromagnetic containment force is usually chosen to be twice as large as the gravitational force resulting in a required flux density of:

$$B_{SF2}=k(2h)^{1/2}421(2h)^{1/2} \text{ for steel} \tag{2'}$$

and:

$$mmf_{SF2} = k(2h)^{1/2}\frac{\sum l}{\mu_o} = 421(2h)^{1/2}\frac{\sum l}{\mu_o} \tag{5'}$$

for steel.

As a measure of the penetration of the electromagnetic surface field into the interior of a thick solid sheet of metal, it is customary to use the "skin depth," defined as:

$$\delta = \left(\frac{\rho}{\pi\mu f}\right)^{1/2} \tag{6}$$

where:

ρ=resistivity;

$\mu=\mu_o\ \mu_r$;

$\mu_r$=relative permeability; and f=frequency.

Both the magnetic field and the current density (electric field) are attenuated and phase shifted as they penetrate the surface. At the skin depth δ, their amplitude is $e^{-1}$ (64%) of that at the surface. For sheets with a thickness d>>δ, the eddy current losses are the same as the losses would be due to an alternating current flowing uniformly in a sheet of thickness d=δ.

The power dissipation per unit surface area, A, in a solid sheet of metal of thickness d>>δ, exposed to an alternating flux density B on its surface, is:

$$\frac{P}{A} = \frac{\rho}{2\delta}\left(\frac{B}{\mu}\right)^2. \tag{7}$$

The following description is for casting steel; however, similar arguments apply for casting other metals provided the material selected for the rollers and low reluctance rims are suitable. All calculations are made for magnetic fields oscillating at 3 kHz.

For molten steel (≧1540° C.), the electrical resistivity is ρ=140 μΩcm (micro-ohm-cm) and with the steel being above its Curie-temperature of ~700° C. its skin depth, from Eq. (6), is:

$$\delta = \left(\frac{140\ \mu\Omega\text{cm}}{\pi\times 0.4\pi\times 10^{-8}\ \Omega\text{scm}^{-1}\times 3\times 10^3\ \text{s}^{-1}}\right)^{1/2} = 1.09\ \text{cm}.$$

The skin depth of the roller rim, made from stainless steel and operating at <300° C. with ρ~93 μΩcm, is δ=0.89 cm. When containing a pool of h=40 cm with a safety factor of two (SF2), the magnetic field at the bottom of the pool (nip) must be from (2'):

$$B\geqq 421(2\times 40)^{1/2}=3.8\ \text{kg}.$$

At the nip, the power dissipation in the molten steel is from (7):

$$\frac{P_{Fe}}{A} = \frac{140\ \mu\Omega\text{cm}}{2\times 1.09\ \text{cm}}\left(\frac{3.8\ \text{kG}}{0.4\pi\ \text{GcmA}^{-1}}\right)^2 = 575\ \frac{\text{W}}{\text{cm}^2}.$$

The ratio of flux density in the molten metal, $B_{Fe}$, to the flux density in the roller rim, $B_{RR}$, next to the molten metal is inversely proportional to the skin depth of the two materials:

$$B_{Fe}/B_{RR}=\delta_{RR}/\delta_{Fe}. \tag{8}$$

Containment flux $\phi_1$ is accumulated by the sidewall (rim) of the roller. For the above conditions the flux density in the roller rim at the nip is:

$$B_{RR}=B_{Fe}\delta_{Fe}/\delta_{RR}=3.8\ \text{kG}\times 1.09\ \text{cm}/0.89\ \text{cm}=4.6\ \text{kG}$$

and the rim losses at the nip are:

$$\frac{P_{RR}}{A} = \frac{93}{2\times 0.89}\left(\frac{4.6}{0.4\pi}\right)^2 = 696\ \frac{\mathrm{W}}{\mathrm{cm}^2}.$$

The losses in the roller rim are 1.21 times larger than the losses in the molten steel; 696 W in an area of 1 $cm^2$ (0.16 $inch^2$) will require extensive internal cooling to keep it from getting very hot (for comparison, a 500 W heating element of an electric cooking range is very much larger than 1 $cm^2$ and glows red). Molten steel is poured into the space enclosed by the rollers and the electromagnetic dams and solidifies on the surface of the rollers. The rollers compress the two solidifying sheets into one cast strip which emerges below the nip. The rollers are conventionally internally water cooled, though other cooling methods including those using cryogens can be used. For a satisfactory cast, the cooling must be uniform over the surface of the roller to uniformly solidify the molten steel. As shown above, the electromagnetic dams cause power dissipation in the side-wall of the molten metal being cast and in the rim of the rollers. The power dissipation in the molten metal is unavoidable (e.g., ~575 W $cm^{-2}$ in the above example) and can be minimized for a given operating frequency only by operating with the lowest flux density that accomplishes containment. The present invention provides a method and apparatus for reducing the eddy current losses in the roller rim (e.g., ~696 W $cm^{-2}$ in the above example) and improves cooling of the rim, thereby increasing cooling effectiveness of the edges of the metal sheet being cast.

Figure 3:
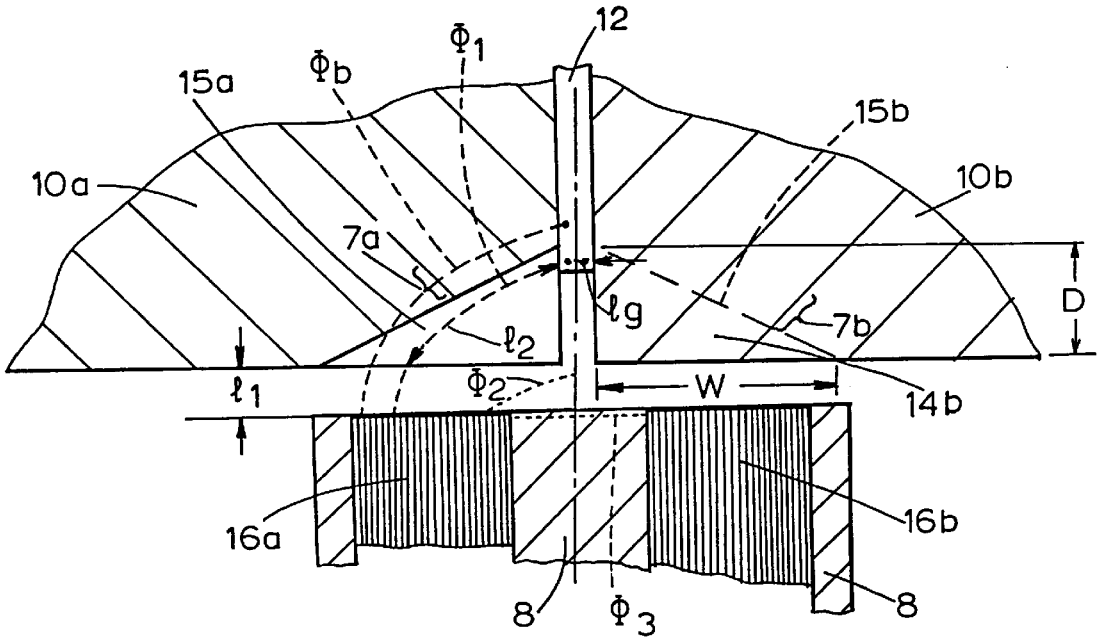
FIG. 3 shows a view along line 3—3 of FIG. 1 with triangular narrow slots showing one preferred embodiment of the invention.
Figure 4:
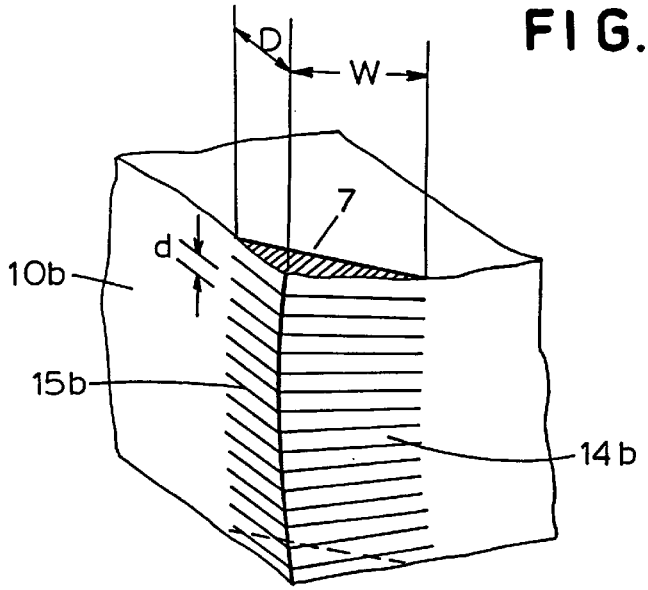
FIG. 4 is an isometric view of a roller edge with narrow slots in accordance with another preferred embodiment of the invention.

One embodiment of the invention is shown in FIG. 3 which is a view similar to the one along line 3—3 of FIG. 1. FIG. 4 is an isometric view of a section of the rim of roller 10*b*. It illustrates how slots 15, shown in FIG. 3, are cut in the rim of a stainless steel roller to produce teeth 14, which have a width W and a depth D. Slots 15 are so narrow that the molten metal cannot penetrate (and short circuit) the slots. In this way, eddy current losses in the teeth are greatly reduced without significantly reducing the cooling efficiency and mechanical strength of the teeth, and the slots do not need to be filled. However, the slots can be filled (e.g., vacuum impregnated) with refractory material to make the roller edge more rigid and to provide a smooth roller circumferential surface. This smooth circumferential surface increases the surface finish quality of the rolled material. In FIG. 3, roller 10*a* shows the triangular shaped slot 15*a* cut into the rim of roller 10*a* and the path of flux $\phi_1$ through the teeth 14 of the low reluctance rim; also shown is the path of flux $\phi_b$ through the base 7 of the teeth. For roller 10*b*, tooth 14*b* and its base 7*b* are shown. The dividing line between tooth 14*b* and base 7*b* is the bottom of the slot shown dashed as line 15*b*.

The effect of slotted rims is illustrated with FIGS. 5 and 6. FIG. 5 shows nonmagnetic laminations in a uniform alternating magnetic field that is normal to the paper. Its relative strength is indicated by the number of crossed circles, ⊗. The eddy current path is illustrated by dashed lines and the relative eddy current magnitude by the size of the arrowheads, →. For nearly uniform flux distribution, the thickness of the lamination d must be smaller than half the skin depth δ. For these conditions, the eddy current losses per unit volume are:

$$\frac{P}{V} = \frac{1}{6\rho}\pi^2 d^2 f^2 B^2 \tag{9}$$

for a given frequency and flux density losses increase with the square of lamination thickness d. The magnetic field and eddy currents in a metal plate with narrow slots 15 of width S, cut to a depth D, producing metal teeth of width d, are illustrated in FIGS. 6A and 6B. For stainless steel with a resistivity of ρ=93 μΩcm, the losses in the slotted rim for a 3.8 kG field of 3 kHz are given below for different teeth-width d;

| $d$ | 0.125 | 0.25 | 0.5 | 1 | cm |
|---|---|---|---|---|---|
| $\frac{P}{V}$ | 3.58 | 14.3 | 57 | 229 | W $cm^{-3}$ |

If the base of the teeth, 7, has a thickness equal to or larger than one skin depth, as illustrated by FIG. 6A, the losses in the base exceed by far the losses in the teeth. For the example of FIG. 6A, the losses would be 475 W $cm^{-2}$ for a 3 kHz field of 3.8 kG. This is very much larger than the losses in teeth of d≦0.5 cm. The losses in the base of the teeth of FIG. 6A are the same as for a thick plate.

Eddy current losses in the base of the teeth can be made the same as in the teeth if the base 7 has the same thickness as the teeth. FIG. 6B illustrates the flux and eddy current pattern for this case. Both types of slotted low reluctance rims as illustrated by FIGS. 6A and 6B can be employed in a variety of practical applications.

For the embodiment of FIG. 3, slots 15 preferably have a width of S≦0.008" (0.02 cm) and are cut with electric discharge machining. To support a 40 cm pool of steel with a safety factor of two, the flux density on the surface of the molten metal at the nip must be $\phi_1$ ≧3.8 kG. Due to the geometry of the magnetic circuit, the magnetic field in the base of the teeth of the low reluctant rim (flux line $\phi_b$) is approximately 2.5 kG. The 3.8 kG in the teeth cause, from Eq. (9), losses of approximately 94 W $cm^{-3}$ and the 2.5 kG on the surface of the base cause losses, from Eq. (7), of approximately 185 W $cm^{-3}$. The total losses of 279 W $cm^{-3}$ are much smaller than if a solid stainless steel roller was used, 696 W $cm^{-3}$, because the magnetic field at the base of the teeth is smaller than the containment field which penetrates the slotted rim. More importantly, the losses are not generated at the surface of the roller which is in contact with the metal sheet being cast. Instead, the losses are primarily generated in the base of the teeth close to the cooling channels of the rollers.

Figure 7:
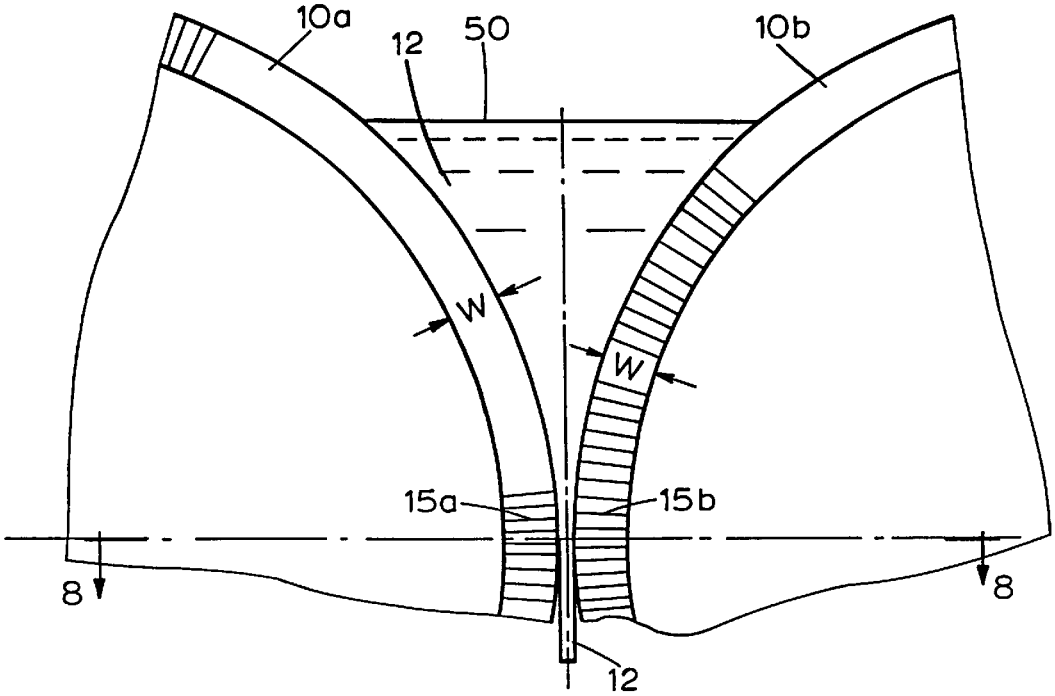
FIG. 7 is a front view of an apparatus for electromagnetic containment with low reluctance rims in accordance with the invention.
Figure 8:
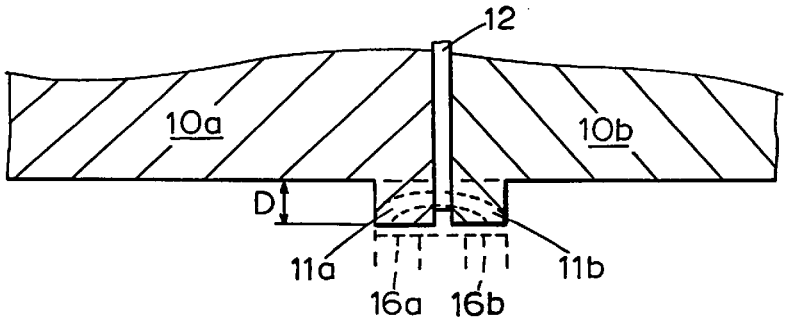
FIG. 8 shows a view along line 8—8 of FIG. 7.
Figure 9:
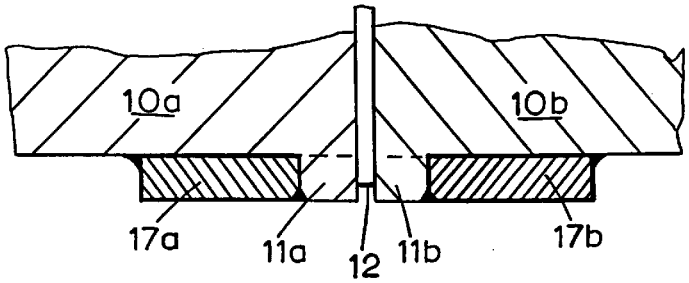
FIG. 9 shows a view along line 8—8 of FIG. 7 with a reinforcing ring added in accordance to the invention.

Another preferred embodiment of the invention is shown in FIGS. 7 and 8. A rectangular rim 11 of width W and depth D has been machined into the sides of the nonmagnetic roller 10. Slots 15, so narrow that molten metal cannot penetrate, have been cut into rim 11 to produce a low reluctance rim. The slots may be cut with electric discharge machining, a laser beam or other suitable means. The reluctance and the eddy current losses of this embodiment are smaller than with the embodiment of FIG. 3 because the rectangular slots of FIGS. 7 and 8 produce an area twice as large as the triangular slots of FIGS. 3 and 4. However, the mechanical strength of the teeth of the low reluctance rim for compressing metal 12 is less than that of FIG. 3. For narrow widths, W, of the low reluctance rim, its mechanical strength can be improved by welding a solid stainless steel rim 17 to the side of the roller as illustrated in FIG. 9.

Figure 10:
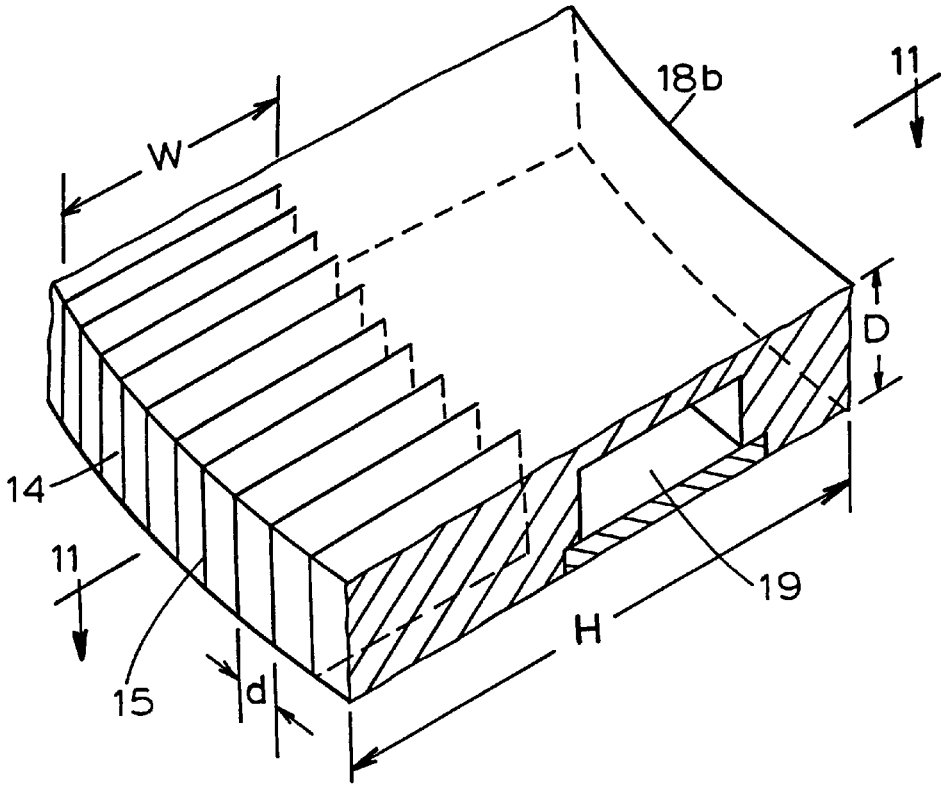
FIG. 10 is an isometric view of a flat disk showing another embodiment of the invention.
Figure 11A:
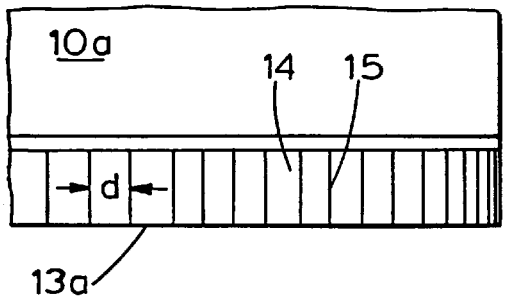
FIG. 11 illustrates one embodiment for fastening the disk of FIG. 10 to rollers.
Figure 11B:
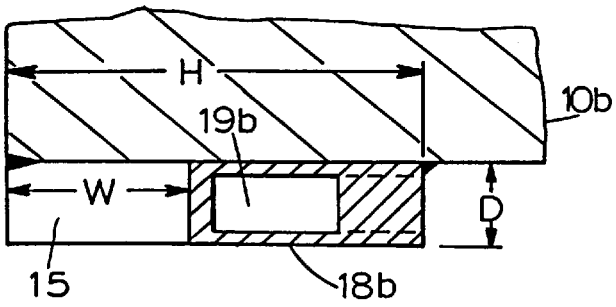

Still another preferred embodiment of the invention is shown in FIGS. 10 and 11 where disk 18 is welded to rollers 10. FIG. 11B is a sectional view along line 11—11of FIG. 10. FIG. 11A is a top view of disk 18*a* welded to the side of roller 10*a*. Disk 18 has a cross-section D×H and slots 15 cut in its circumference to a depth W to produce low reluctance teeth 14 of width d. The disks 18 are made from stainless steel and have water-cooled channels 19. They are conventionally fastened to the rollers with screws and welds. Seam welds on the roller surface are machined to obtain a smooth surface and good thermal conduction between internally water-cooled roller 10 and the molten metal 12 being cast into a sheet.

Figure 12:
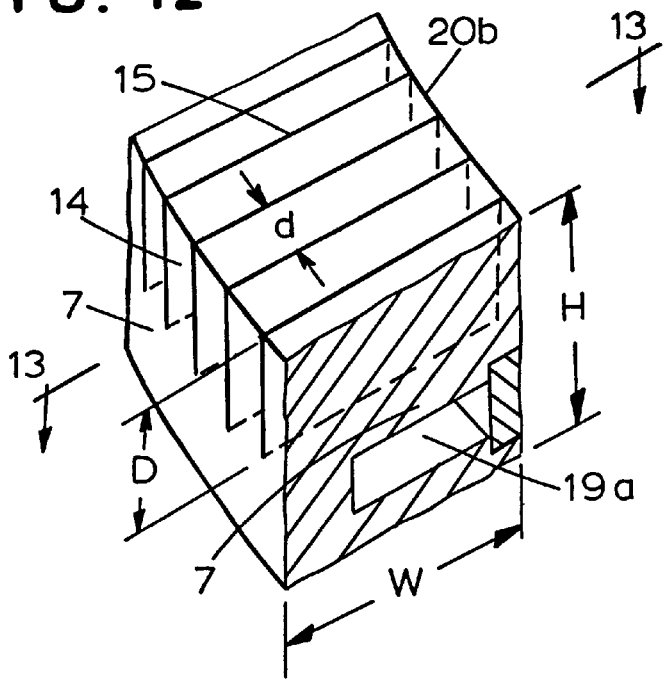
FIG. 12 is an isometric view of another disk constructed in accordance with another embodiment of the invention.
Figure 13A:
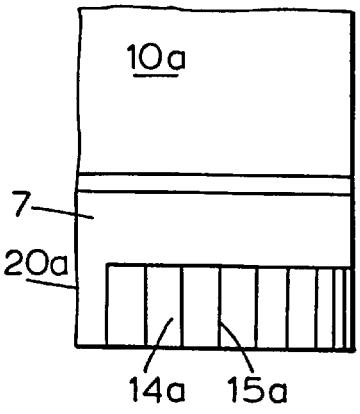
FIG. 13 illustrates how the disk of FIG. 12 is fastened to the rollers.
Figure 13B:
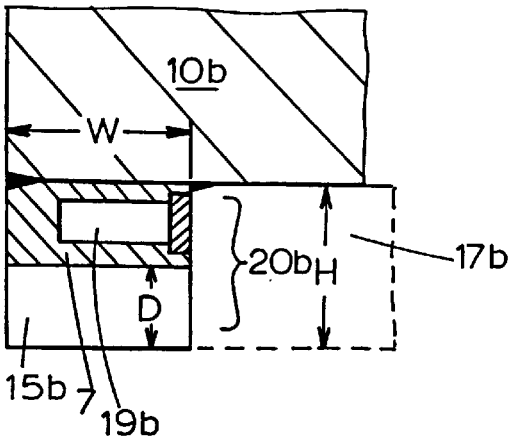

For more intensive water cooling of teeth 14, and also in case roller 10 is made from ferromagnetic material ($\mu_r$>>1), the embodiment of the invention shown in FIGS. 12 and 13 is preferred. The stainless steel disk 20 has width W and height H into which narrow slots 15 are cut to a depth D producing teeth 14. The base of the low reluctance rim teeth has a cooling water channel 19. Disk 20 is welded to rollers 10. Disk 20 may be reinforced with a second solid disk 17, welded behind it as shown in dashed lines in FIG. 13B. One wall of the cooling water channel is the base 7 for the teeth 14 of the low reluctance rim. The wall thickness is chosen for reducing eddy current losses as was explained earlier with reference to FIG. 6B.

Another embodiment of the invention shown combines the triangular teeth design of FIG. 3 and the low eddy current losses in the base 7 of the teeth as illustrated in FIG. 6B. The low reluctance rim is made from stainless steel. Its triangular teeth will deform less than rectangular teeth. The upper wall of its cooling water channel is the base for teeth. The wall thickness for is chosen less than one skin depth to reduce eddy current losses. The solid portion of the rim is wide enough to prevent deformation of the rim.

Eddy current losses in solid metal due to surface fields are, from Eqs. (6) and (7), proportional to the square root of the resistivity of the metal:

$$\frac{P}{A} \propto \frac{\rho}{\delta} = \left(\frac{\rho^2 \pi \mu f}{\rho}\right)^{1/2} \propto (\rho)^{1/2}. \tag{10}$$

Eddy current losses on the surface of the reinforcing rim portion due to leakage flux $\phi_o$ from magnet poles 16 can be reduced significantly by providing a copper shield 28 on top of it. The shield should be at least one skin depth thick; which, for copper, is 0.12 cm at 3 kHz. From Eq. (10), the eddy current losses in copper, $P_{Cu}$, are only 15% of the losses in stainless steel, $P_{SS}$, are:

$$P_{Cu}=P_{SS}(\rho_{Cu}/\rho_{SS})^{1/2}=(1.73/75)^{1/2}P_{SS}=0.15\ P_{SS}.$$

It should be noted that, because of the shielding effect of copper versus stainless steel, eddy current losses in the stainless steel base of the teeth of the embodiment of FIGS. 12 and 13 can be reduced further if a rectangular copper tube is brazed into the cut-outs of the cooling water channels 19.

Figures 14, 15, 16, 17, 18, 19, 20, 21:
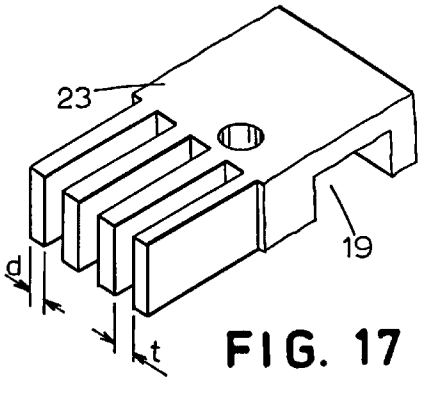
FIG. 14 is an isometric view of the lower part of a low reluctance rim of the present invention.
FIG. 15 is a top view of the isometric view of FIG. 14.
FIG. 16 is a view along line 16—16 of FIG. 15.
FIG. 17 is an isometric view of the upper part of a low reluctance rim of the present invention.
FIG. 18 is a top view of the isometric view of FIG. 17.
FIG. 19 is a view along line 19—19 of FIG. 18.
FIG. 20 is a top view of the assembly of the lower and upper parts shown in FIGS. 14 and 17.
FIG. 21 is a view along line 21—21 of FIG. 20.

Cutting narrow slots into metal with electric discharge machining is very expensive; for rollers of 100 cm diameter the cost may exceed $50,000. For some applications, this cost can be readily justified. However, this high cost can be avoided with the preferred embodiments of the invention shown in FIGS. 14 through 26. These embodiments provide low reluctance rims by meshing two conventionally machine-cut stainless steel disks. Slot widths or spaces 15, so narrow that molten metal cannot penetrate them, are achieved by meshing the teeth 14 cut into two stainless steel disks. Disks 22 mounted to roller 10 are shown isometrically in FIG. 14; FIG. 16 is a top view of FIG. 14, and FIG. 16 a cut along line 17—17 of FIG. 15. FIG. 17 is an isometric view of the stainless steel disk 23, which has teeth that mesh into the teeth of disk 22 with a space 15 of width S. FIG. 18 is a top view of FIG. 17 and FIG. 19 shows the view along line 20—20 of FIG. 18.

Teeth in both disks 22 and 23 have a width d, chosen to reduce eddy current losses in the low reluctance rim to acceptable values. The spacing t between the teeth is t=d+2S where S is equal to the desired width of space 15. FIG. 20 is a top view of the assembled low reluctance rim; FIG. 21 is a view along line 22—22 of FIG. 20. In this embodiment of the invention, both disks 22 and 23 have water-cooled channels 19. To improve the rigidity of the surfaces of the low reluctance rim in contact with molten metal, the bottom edge of the teeth of disk 23 are welded to the base of the teeth of disk 22. Optionally the top rear edge of disk 22 may be welded to disk 23. The spaces 15 in FIG. 20 are shown filled with refractory material 25.

For some applications it may not be necessary to water cool base 7 of the disk 22 which is sandwiched between water-cooled disk 23 and the water-cooled roller 10. Disk 23 and the roller 10 may be sufficient heat sinks for disk 22; this is especially true if the roller 10 is made from a copper alloy.

More rigidity of the low reluctance rim and better heat transfer from the low reluctance rim surface, in touch with the molten metal, and the low reluctance rim-cooling water channels can be achieved if the teeth of disk 23 are brazed and/or welded to the base of disk 22. For this purpose, grooves G may be machined into the base of disk 22 as illustrated in FIG. 22; and the teeth of disk 23 may be extended as illustrated in FIG. 23 to a height D+G. A similar technique may be employed to obtain the performance of the electric discharge machine-cut low reluctance rim shown in FIGS. 12 and 13 with relatively inexpensive, conventional machine-cut parts as illustrated by FIGS. 24, 25 and 26. By cutting teeth 14*a* and gaps or grooves G into the disk of FIG. 24, one can insert the machined teeth 14*b* of FIG. 25 into the grooves G of the disk. The additional teeth are brazed and/or welded to the disk producing a low reluctance rim surface as shown in FIG. 26.

For rollers made from copper alloy, losses are kept small by making the low reluctance rim without a base portion, similar to the low reluctance rim of FIG. 10, or by making the thickness of the base small as shown in FIG. 6B. The teeth of the low reluctance rim are cooled by a water channel 19 in the low reluctance rim assembly and by the roller acting as a heat sink; the teeth may be extended into the roller and brazed to the roller.

Figure 27:
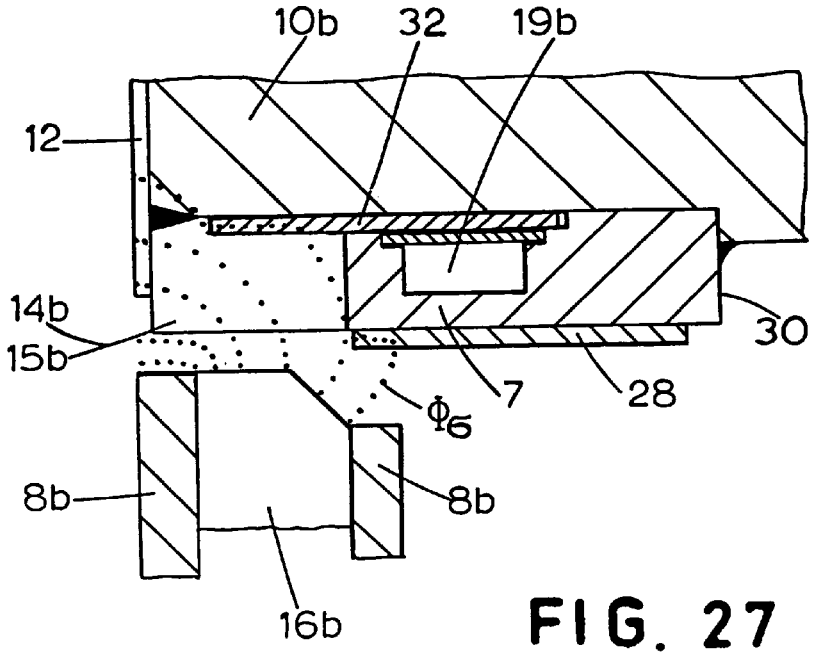
FIG. 27 is a cross-section of a low reluctance rim of the present invention featuring eddy current shields.

For rollers made from stainless steel or ferromagnetic steel, the embodiment of disk 30 shown in FIG. 27 reduces losses by incorporating a copper shield 32 under the teeth of the low reluctance rim except for the teeth area which is welded to the roller. This embodiment is a modification of the embodiment shown in FIGS. 10 and 11. The disk 30 is preferably reinforced by welding it into a space or ledge cut out on the side of the rollers. In place of electric discharge machine-cut teeth, machine-cut teeth with welded or brazed insert teeth can be employed to reduce manufacturing costs similar to the procedure outlined for the embodiment shown in FIGS. 24, 25 and 26. A second copper shield 28 on top of the low reluctance rim reduces eddy current losses due to leakage flux $\phi_o$. The low reluctance rim is cooled from the roller via conduction through the welds, via the copper shield 32 and by cooling water channel 19 cut into the solid portion of disk 30.

Rollers of multilayer construction often simplify the design of low reluctance rims if the outer layer extends beyond the inner roller and has narrow slots to produce a low reluctance rim. The water-cooled inner roller serves as an eddy current shield and heat sink.

Figure 28:
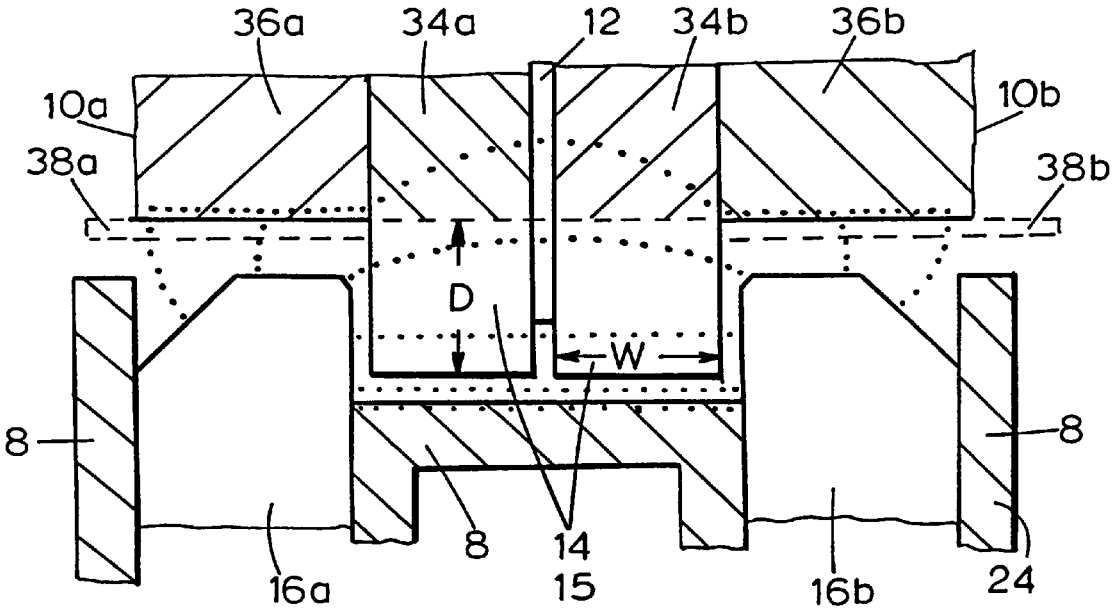
FIG. 28 is a cross-section of a low reluctance rim of the present invention having the outer layer of the roller extended to be a low reluctance rim.

In the example of FIG. 28, outer roller layer 34 is preferably made from stainless steel. It extends beyond inner roller layer 36, preferably made from copper alloy. The extension of layer 34 is slotted to provide a low reluctance rim with a cross-section W×D. The flux path between magnet poles 16 is illustrated by dotted lines. The skin depths at 3 kHz for stainless steel and copper are 1.09 cm and 0.12 cm, respectively. In this embodiment, the magnet poles 16 protrude beyond the inner shield 8 of magnet 24. If the inner roller 36 is made from steel and the outer roller layer 34 from stainless steel or a copper alloy, nearly the same field distribution and reduction in eddy current losses can be achieved if a copper shield 38 is placed on the sides of inner roller 36 as indicated by dashed lines in FIG. 28. Copper sheet 38 shields the inner roller 36 thereby reducing eddy current losses which are proportional to the square root of resistivity.

Significant improvements in electromagnetic sidewall containment can be achieved with ferromagnetic low reluctance rims. With a ferromagnetic low reluctance rim:

- The flux distribution over the magnet pole face and through the ferromagnetic low reluctance rim is much more uniform as compared to a nonmagnetic low reluctance rim; this can prevent hot spots.
- The magnetomotive force to drive a given flux through the roller rim is considerably smaller as compared to a nonmagnetic low reluctance rim.
- Rim losses are reduced to about 30% of the losses of a comparable stainless steel low reluctance rim.

The disadvantage of ferromagnetic low reluctance rims as compared to nonmagnetic low reluctance rims is a more complex rim design. The Curie-temperature of grain oriented silicon steel is 730° C.; therefore, the ferromagnetic laminations must be protected from the much hotter (≧1540° C.) solidifying steel which is in contact with the low reluctance rim surface during the time the metal solidifies. As illustrated in FIG. 1, the arc of contact of the roller with molten metal is:

$$\alpha = \sin^{-1}\frac{h}{R}.$$

The time of contact of the surface of the ferromagnetic low reluctance rim, and the exposure of the laminations of the ferromagnetic low reluctance rim to magnetic fields, is typically 12% of the time for one revolution of the rollers.

A top view of one embodiment of a ferromagnetic low reluctance rim is shown in the FIG. 29. FIG. 30 is a side view of the ferromagnetic low reluctance rim; the side in contact with the metal 12 being cast. FIG. 31 is a view along line 32—32 of FIG. 29. Ring 40 is formed from rectangular stainless steel and welded together. It has narrow electric discharge machine- or laser-cut slots to a depth D and has a width W to produce a low reluctance flux path. The width W of ring 40 is smaller than the width W of the low reluctance rim of FIGS. 3 through 27 because ring 40 is not located underneath magnet poles 16. Ring 40 is welded to water-cooled stainless steel disk 42 and thereafter to roller 10. Silicon steel laminations 44 are preferably glued to ring 40 and disk 42 with high temperature adhesive 46 and secured with stainless steel pressure plates 48 to disk 42 with stainless steel hardware 52. The adhesive 46 should have a thermal expansion compatible with metals and have good thermal conductivity; magnesia-based adhesive has these properties and a service temperature exceeding 1000° C. The silicon steel lamination 44 can readily be purchased as glued subassemblies as shown in FIG. 32. The disk 42 can also be made from copper; this improves thermal conductivity but reduces compressive strength as compared to stainless steel.

Figure 33:
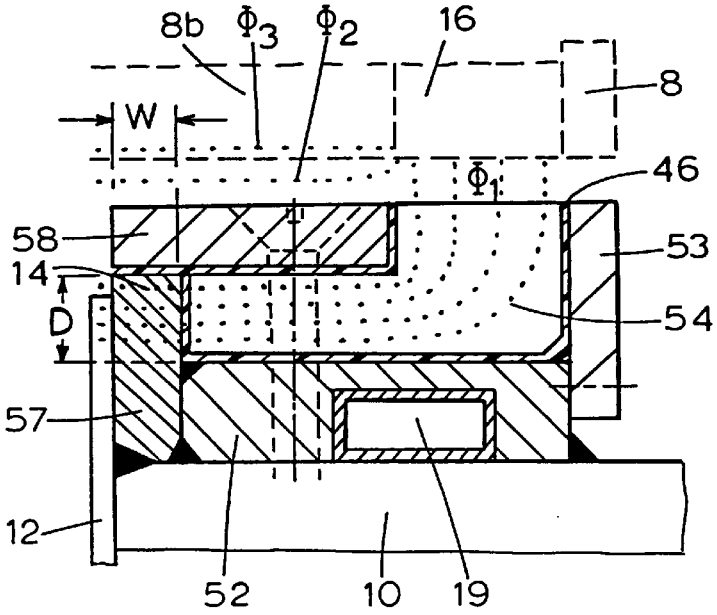
FIG. 33 is a cross-section of another ferromagnetic low reluctance rim embodiment of the present invention.

FIG. 33 is a cross-section similar to the one of FIG. 31 showing an embodiment of the invention which has wider separation of magnet poles 16. This is desirable, especially in the nip area, because it reduces leakage fluxes $\phi_2$ and $\phi_3$ without changing useful flux $\phi_1$.

Figure 34:
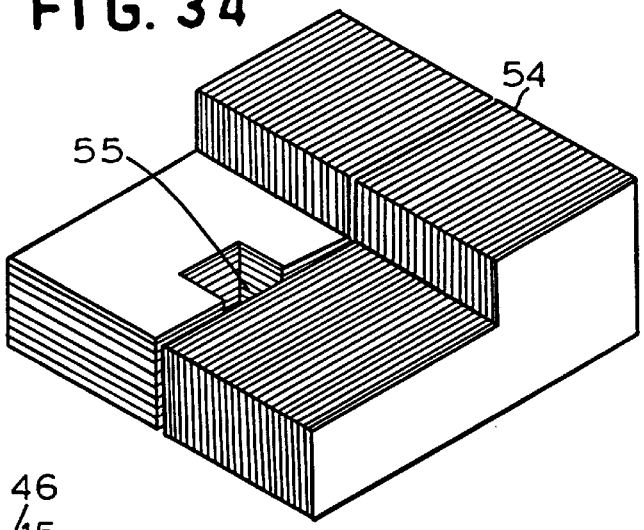
FIG. 34 is an isometric view of the ferromagnetic laminations of FIG. 33.
Figure 35:
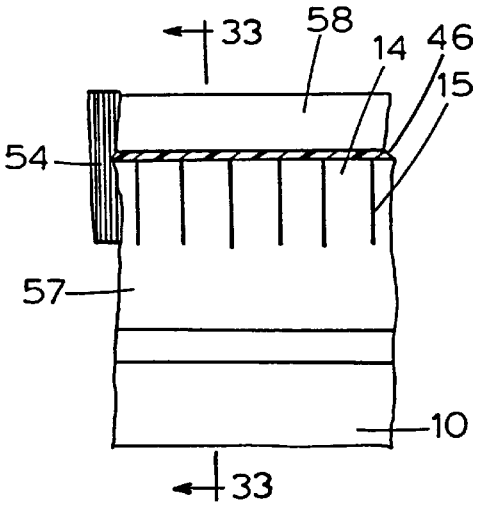
FIG. 35 is a front view of the ferromagnetic low reluctance rim embodiment of FIG. 33.

The wider spacing of magnet poles 16 is achieved with L-shaped silicon laminations 54 which are turned 180° horizontally as compared to the laminations 44 shown in FIG. 31. FIG. 34 is an isometric view of subassemblies of laminations 54; some of them have holes 55 to accommodate mounting hardware for the pressure plate 58. A slotted ring 57 and a disk 52 serve the same purpose as was described for ring 40 and disk 42 of FIG. 31. A copper ring 53 serves as an eddy current shield which prevents leakage flux. FIG. 35 illustrates a side view of the ferromagnetic low reluctance rim.

By turning the L-shaped silicon lamination of FIGS. 33 and 34 vertically 180°, the embodiment of FIG. 37 is realized. Parts 60, 62, 63, 64 and 68 in FIG. 36 serve the purpose described for parts 57, 52, 53, 54 and 58 for FIG. 34, respectively. In the embodiment of FIG. 36, magnet poles 16 protrude from the magnet assembly as described in the parent U.S. Pat. Nos. 4,936,374 and 5,385,201.

The embodiment of FIG. 37 uses L-shaped subassemblies of silicon laminations as shown in FIG. 38. It achieves the same as the embodiment of FIG. 33. However, ring 57 and disk 52 are combined into one machined disk 53 which has narrow slots and teeth 14 for a low reluctance path for the containment flux. These narrow slots can either be cut by means of electric discharge machining or with a laser beam as illustrated in FIG. 35; or they can be produced by machining wide slots, as described earlier for the embodiment of FIG. 24, and filling the wide slots with brazed and/or welded teeth as illustrated by FIGS. 25 and 26.

Still another embodiment of the invention is shown in FIG. 39 where the L-shaped silicon steel lamination of FIGS. 33 through 38 have been replaced by ferromagnetic laminations 74. These laminations may be hoops or stamped arced sections or packages as shown in FIG. 40. The package of FIG. 40 is shown with machined vertical laminations; the same isometric volume may be made from machined horizontal laminations.

Figure 41:
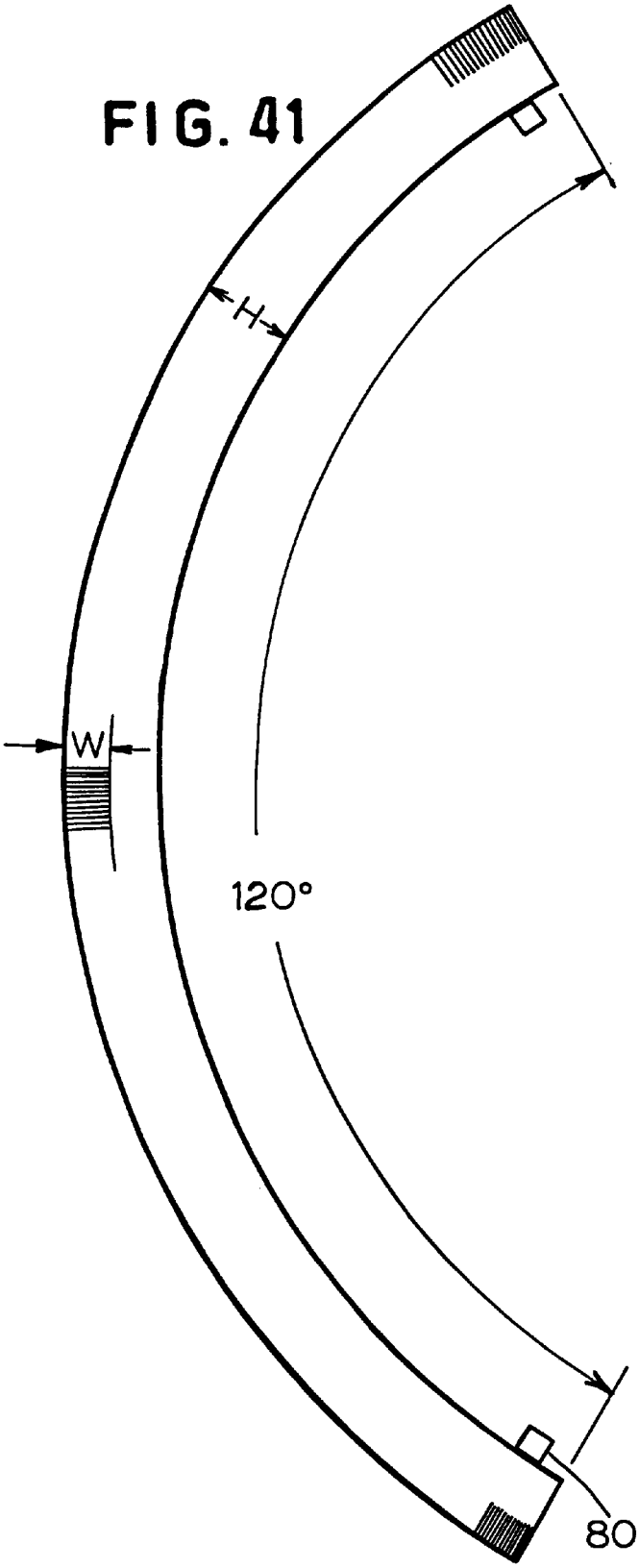
FIG. 41 is a top view of a 120°-section of a roller-mounted low reluctance rim of the present invention.
Figure 42:
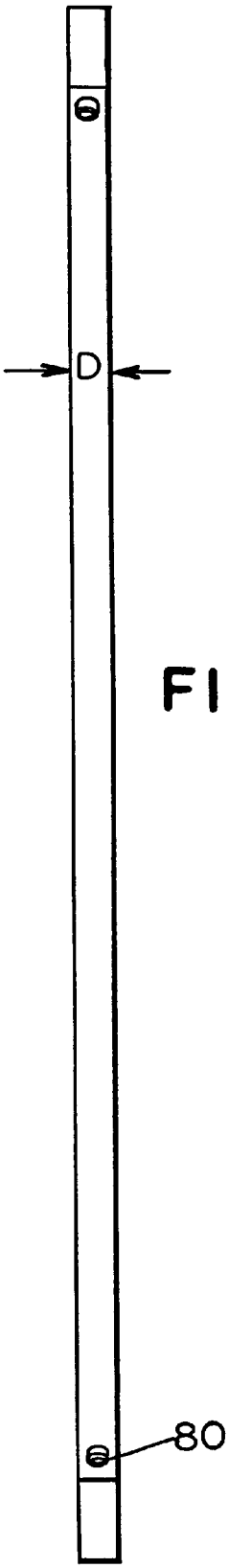
FIG. 42 is a side view of the low reluctance rim of FIG. 41.

The low reluctance rims and the ferromagnetic low reluctance rims of the embodiments of FIGS. 10 through 39 can be assembled as complete rings and attached to the roller sides with mounting hardware, by welding, brazing or other suitable means. In many cases it may be better to make the low reluctance rim (ferromagnetic low reluctance rim) from partial sections of complete rings to facilitate mounting of the low reluctance rim (ferromagnetic low reluctance rim) to the rollers and replacement of a damaged section. These sections may be reinforced (supported) from a solid disk machined into the side of the rollers or welded to the side of the rollers. FIGS. 41 and 42 illustrate one of three 120°-sections of a low reluctance rim which is similar to the one shown in FIGS. 10 and 11. Fittings 80 are provided for water cooling of each section.

For the ferromagnetic low reluctance rims described in the above embodiments, silicon steel laminations have been shown. In their place, other ferromagnetic material suitable for alternating magnetic fields may be used, including amorphous metallic glass and high temperature ferrites. Of course, low reluctance rims (ferromagnetic low reluctance rims) are also applicable with electromagnetic dams that employ ferromagnetic dams as described in U.S. Pat. Nos. 4,936,374 and 5,385,201.

While preferred embodiments of the invention have been shown and described, it will be clear to those skilled in the art that various changes and modifications can be made without departing from the invention in its broader aspects as set forth in the claims provided hereinafter.

What is claimed is:

1. An apparatus for casting sheets of metal from molten metal, comprising:

a containment means having an open side and including a rim portion and counter-rotating rollers spaced apart and defining the open side;

horizontal alternating magnetic field production means for containing molten metal in at least a first portion of said open side with an electromagnetic force; and a low reluctance structure for reducing eddy current losses in the rim portion of said containment means, said structure being disposed adjacent said open side and said low reluctance structure further including slots cut into the rim portion of the rollers and high permeability inserts coupled adjacent to the rollers and located behind said slotted low reluctance structure.

2. The apparatus as defined in claim 1, wherein said horizontal alternating magnetic field production means includes a plurality of substantially horizontally spaced magnet poles and a nonmagnetic, electrically conductive shield disposed between the magnet poles adjacent said open side.

3. The apparatus as defined in claim 1, wherein said slots are dimensioned such that the molten metal cannot penetrate said slots.

4. The apparatus as defined in claim 1, wherein triangular slots are cut into said circumferential rim of said rollers.

5. The apparatus as defined in claim 1, wherein the low reluctance rim is mounted to said roller sides substantially flush with a surface of said roller, said low reluctance rim comprising two meshing, water-cooled disks dimensioned such that when the teeth of said disks are meshed, spaces are formed of dimensions so narrow that molten metal cannot penetrate said spaces.

6. The apparatus as defined in claim 1, wherein the low reluctance rim is coupled to sides of said roller substantially flush with a surface of said roller, said low reluctance rim comprising a stainless steel water-cooled disk with a gap between teeth on said rim formed wide enough that an equally wide tooth can be disposed between each pair of teeth of said disk, leaving a space between said teeth being dimensioned such that molten metal cannot penetrate said space.

7. The apparatus as defined in claim 5, wherein a copper shield at least one skin depth thick separates said low reluctance rim from sidewalls of said rollers.

8. The apparatus as defined in claim 1, wherein said slots are substantially filled with a refractory material.

9. A magnetic containment apparatus for preventing escape of molten metal through an open side of a gap between two spaced apart counter-rotating rollers between which the molten metal is located, said apparatus comprising:

a magnetic core;

an electrically conductive coil capable of energizing said magnetic core;

said magnetic core comprising a pair of horizontally disposed, spaced magnet poles disposed adjacent the open side of said rollers for generating a substantially horizonal magnetic field which extends through the open side of said gap to the molten metal;

a nonmagnetic, electrically conductive shield disposed between the magnet poles adjacent to the open side of said gap; and a disk structure comprised of a nonmagnetic material and formed in a circumference of each sidewall of said rollers for providing a low reluctance rim for the alternating magnetic flux wherein slots are cut into said disk structure, said slots having narrow dimensions such that the molten metal cannot penetrate said slots and high permeability inserts coupled adjacent to the rollers and located behind said slotted low reluctance rim.

10. The apparatus as defined in claim 9, wherein a substantially solid disk is welded to an inside portion of said slotted disk structure for structural reinforcement.

11. The apparatus as defined in claim 9 wherein slots are machined into said disk structure to engage teeth cut into a mating disk that mesh into said slots, said teeth of said mating disk and said slots being dimensioned to create at least one space at each of said teeth when meshed, said spaces being dimensioned such that molten metal cannot penetrate said spaces and wherein said mating disk is coupled to a sidewall and a surface of said roller and is water cooled to enhance solidification of the metal being cast.

12. The apparatus as defined in claim 9, wherein both a slotted rim portion of said disk and a solid water-cooled portion of said disk contacts a sidewall of a low electrical resistivity roller.

13. The apparatus as defined in claim 9, wherein only a solid, water-cooled portion of said disk is in contact with a sidewall of a high electrical resistivity roller and a slotted rim portion is separated from said sidewall of said roller by the thickness of the water-coiled portion of said disk.

14. The apparatus as defined in claim 13, wherein a cooling water channel in said low reluctance rim reduces eddy currents in the base of said low reluctance rim by reducing a cross-section of a base for flux penetration to less than one skin depth.

15. An apparatus for casting sheets of metal from molten metal comprising:

counter-rotating multilayered rollers spaced apart and defining a gap between said rollers with said rollers having a stainless steel sleeve disposed over at least a portion of a water-cooled core, said sleeve protruding over a sidewall of said core of said roller at least one skin depth of the metal being cast;

a magnet capable of generating a substantially horizontal alternating magnetic field, said magnet including magnetic poles protruding immediately behind said sleeve;

a nonmagnetic, electrically conductive shield disposed between the magnet poles adjacent to the open side of the gap; and radial slots cut into the protruding sleeve of said rollers to produce a low reluctance rim and flux path which cannot be penetrated by the molten metal and the magnetic poles being behind the slots and high permeability inserts coupled adjacent to the rollers and located behind said slotted low reluctance rim.

16. An apparatus for casting sheets of metal from molten metal comprising:

counter-rotating water-cooled rollers spaced apart and defining a gap between said rollers, said rollers having slotted low reluctance rims protruding from their sides near edges of said rollers and extending flush with a surface in contact with molten metal;

high permeability inserts coupled adjacent to said rollers and located behind said slotted low reluctance rims;

a magnet capable of generating a substantially horizontal alternating magnetic field, said magnet including two magnetic poles; and a nonmagnetic, electrically conductive shield disposed between said magnet poles adjacent to the open side of the gap.

17. The apparatus as defined in claim 16, wherein said slots are produced by meshing two sets of relatively wide teeth, at least one set of said teeth being part of a disk and the high permeability insert being mounted adjacent said slots.

18. The apparatus as defined in claim 16, further including a copper shield between a bottom portion of at least part of said high permeability inserts and the sides of said rollers to reduce flux from entering the sidewalls of said rollers.

* * * * *